United States Patent [19]

Thomas

[11] Patent Number: 4,936,763

[45] Date of Patent: Jun. 26, 1990

[54] CONCRETE MOULDING APPARATUS

[76] Inventor: Brian Thomas, 4 De Havilland Avenue, Benowa, Queensland, 4217, Australia

[21] Appl. No.: 193,257

[22] Filed: May 11, 1988

[30] Foreign Application Priority Data

May 13, 1987 [AU] Australia ..... PI1907

[51] Int. Cl.[5] ..... B28B 13/02

[52] U.S. Cl. ..... 425/64; 264/33; 404/98

[58] Field of Search ..... 425/64, 63; 249/2; 264/31, 33; 404/98, 96

[56] References Cited

U.S. PATENT DOCUMENTS

| | | | |
|---|---|---|---|
| 2,932,875 | 4/1960 | Butcher | 425/64 |
| 3,733,141 | 5/1973 | James, III | 404/98 |
| 3,957,405 | 5/1976 | Goughnour | 425/63 |
| 4,310,293 | 1/1982 | Eggleton | 425/62 |
| 4,566,823 | 1/1986 | May | 404/98 |

FOREIGN PATENT DOCUMENTS

| | | | |
|---|---|---|---|
| 13223 | 5/1969 | Australia | 425/64 |
| 528167 | 3/1980 | Australia | 425/64 |
| 637408 | 2/1962 | Canada | 425/64 |
| 1448574 | 9/1976 | United Kingdom | 425/64 |

*Primary Examiner*—Jay H. Woo
*Assistant Examiner*—K. P. Nguyen
*Attorney, Agent, or Firm*—McAulay Fisher Nissen & Goldberg

[57] ABSTRACT

Concrete moulding apparatus (10) is provided which has a mould (19) through which concrete is extruded from a hopper (17) by the action of a pusher plate (22) reciprocating in the hopper (17) towards and away from the mould entrance (20). The pusher plate (22) is arranged to pivot during reciprocation to cause excess material forced towards the mould entrance (20) to be squeezed upwardly back into the hopper (17).

18 Claims, 2 Drawing Sheets

CONCRETE MOULDING APPARATUS

FIELD OF THE INVENTION

This invention relates to molding of extruding apparatus and in particular it relates to concrete molding apparatus for on-site forming of continuous moldings or extrusions such as garden edging and curbing and the like.

DESCRIPTION OF RELATED ART

Many types of concrete molding machines have been provided in the past for forming continuous concrete moldings or extrusions. These range from relatively large sophisticated machines used for laying concrete roadside curbing to a particular datum line to small machines for forming concrete garden edging and the like. Generally the latter type machines incorporate a hopper adapted to feed concrete to the inlet of a mold and extruding means for forcing concrete through the mold and as a result, advancing the machine.

Australian Pat. Specification No. 528167 illustrates such a machine. While these types of machines operate effectively there are various disadvantages associated with their particular arrangements. For example, most molding machines are provided with quickly detachable molds so that the cross-sectional configuration of the molded product may be varied. Different molds have varying cross-sectional depths across the width thereof and for efficient use each mold must be associated with a correspondingly shaped plunger. Thus, when the molds are changed the plunger must also be changed.

Another disadvantage of such machines is that the operator must carefully monitor the concrete mix feed into the lower portion of the hopper which is associated with the extrusion means, which is generally in the form of a plunger, so that a continuous supply of concrete is fed to the mold. If this feed is not carefully monitored, voids may be formed in the concrete extrusion.

Such concrete molding machines are generally propelled by the action of the extruding means pushing concrete through the mold. Accordingly, the operational speed of such molding apparatus depends on the volume of concrete which can be forced through the mold with each cycle of the pusher means.

If the resistance to movement of the pusher means is significantly increased as the latter moves towards the mold, which may be as a result of the pusher means tending to compress concrete against an opposing face of the hopper or mold, the drive motor and the transmission means may be overloaded. Furthermore, excess concrete may escape downwardly and lift the side edges of the mold from the ground. This may result in formation of a rough lower edge portion in the molding and variations in the cross-sectional configuration of the molded product.

SUMMARY OF THE INVENTION

The present invention aims to alleviate the above-mentioned disadvantages and to provide concrete molding apparatus which will be reliable and efficient in use. Other objects and advantages of this invention will hereinafter become apparent.

With the foregoing and other objects in view, this invention in one aspect resides broadly in concrete molding apparatus of the type having a mold through which concrete is extruded and extruding means for forcing concrete through said mold, characterized in that said extruding means includes pusher means supported for pivotal motion whereby the latter may pivot during movement towards and away from said mold. Preferably the pusher means is supported for pivotal movement about a pivot axis disposed forwardly of the pusher means whereby the latter, during its rearward movement to extrude concrete mix from said mold, moves to an inclined position at the rear of its stroke. Of course the pivot axis could be disposed rearwardly of the pusher means if required.

The mold may have a stepped or non-uniform cross-sectional configuration and the pusher means may include a pushing face extending across the mold and adapted to substantially conform to the cross-section of the mold. Preferably however, the pusher means has a planar pushing face which extends substantially across the width of the mold.

The side walls of the mold may extend forwardly to form the lower side wall portions of the hopper and the pusher means may be arranged for close movement between the forward extension of the side walls. Preferably, the pusher face is arranged so that as it moves to its rearmost position adjacent the entrance to said mold, it moves to an inclined position in which its upper portion is spaced from the entrance to the mold further than its lower portion. With this configuration and a planar pusher face the pusher means may be used in association with molds having various crosssectional configurations since excess concrete mix or like material forced towards the mold, and specially any fixed or blanking end faces thereof, can escape upwardly, assisted by the upward pivotal motion of the pusher face.

It is also preferred that the pusher means be so made and arranged that when in its forward most position at which concrete is free to fall through the hopper into the lower portion thereof, the pusher face extends downwardly and forwardly from the back face of the hopper so as not to inhibit movement of concrete through the hopper into the lower portion thereof. However the inclination of the pusher face can be varied as desired.

Preferably the pusher means is in the form of a plate mounted rigidly to a pivot frame but of course if desired it could be connected to a pivot frame by linkage mean adapted to accentuate the sweeping or oscillating action of said pusher plate as it moves through the lower portion of the hopper towards the mold.

BRIEF DESCRIPTION OF THE DRAWING

In order that this invention may be more readily understood and put into practical effect, reference will now be made to the accompanying drawings which illustrate a typical embodiment of the present invention, wherein.

DESCRIPTION OF THE PREFERRED EMBODIMENT

Figure 1:
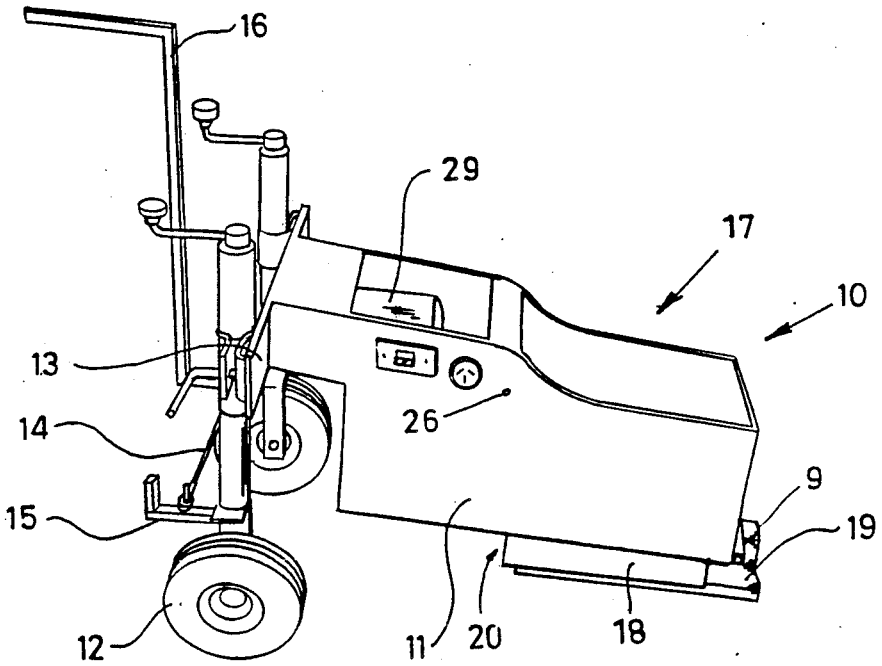
FIGS. 1 and 2 are opposite perspective views of a concrete molding machine.
Figure 2:
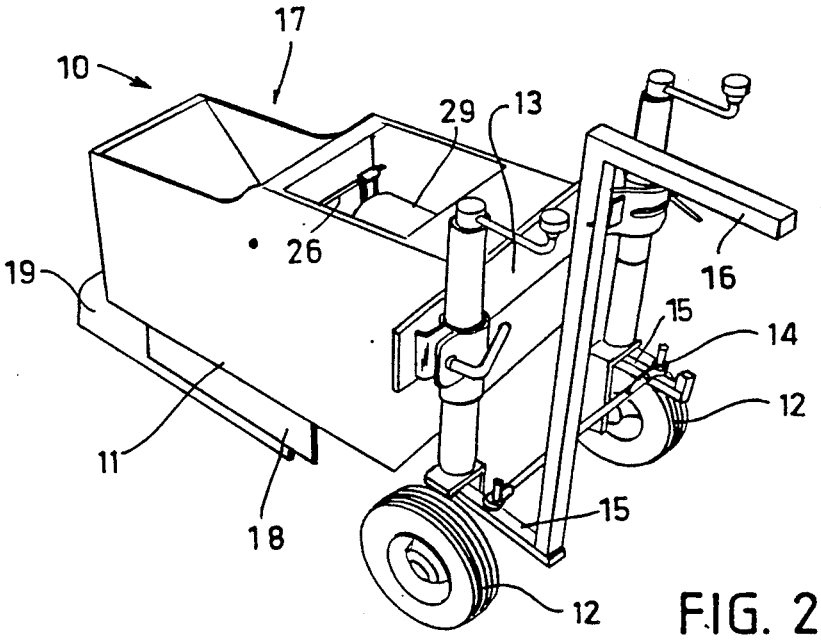

The concrete molding apparatus 10 illustrated in the drawings has a body portion 11 supported at its trailing end by a pair of independently height adjustable wheels 12 mounted on a transverse frame 13 which can be slid across the rear face of the body 11 so as to position the latter either centrally of the wheels 12 or at one or either side thereof to enable the body 11 to pass close to a plant or a garden or the like.

The wheels 12 are steerable and they are interconnected by a linkage bar 14 connected between steering arms 15 on each wheel support. Each steering arm has an upwardly extending spigot 15a at its outer end for selective engagement within the lower portion of a steering bar assembly 16 by which the machine may be steered for movement in the desired direction. A transversely extending square sectioned tubular socket 9 is supported at the rear end of the body 11 so that if desired, a rear wheel may be attached to the body to maintain the body in a fixed position above the ground.

The trailing end of the body 11 supports a hopper assembly 17 having an open bottom extending between opposed longitudinal side walls 18 between which the selected mold, such as a stepped mold 19 illustrated, is secured. The mold 19 is supported beneath the trailing portion of the body 11 and extends rearwardly thereof. The lower longitudinal edges of the mold 19 are arranged to rest upon the ground.

Figure 3:
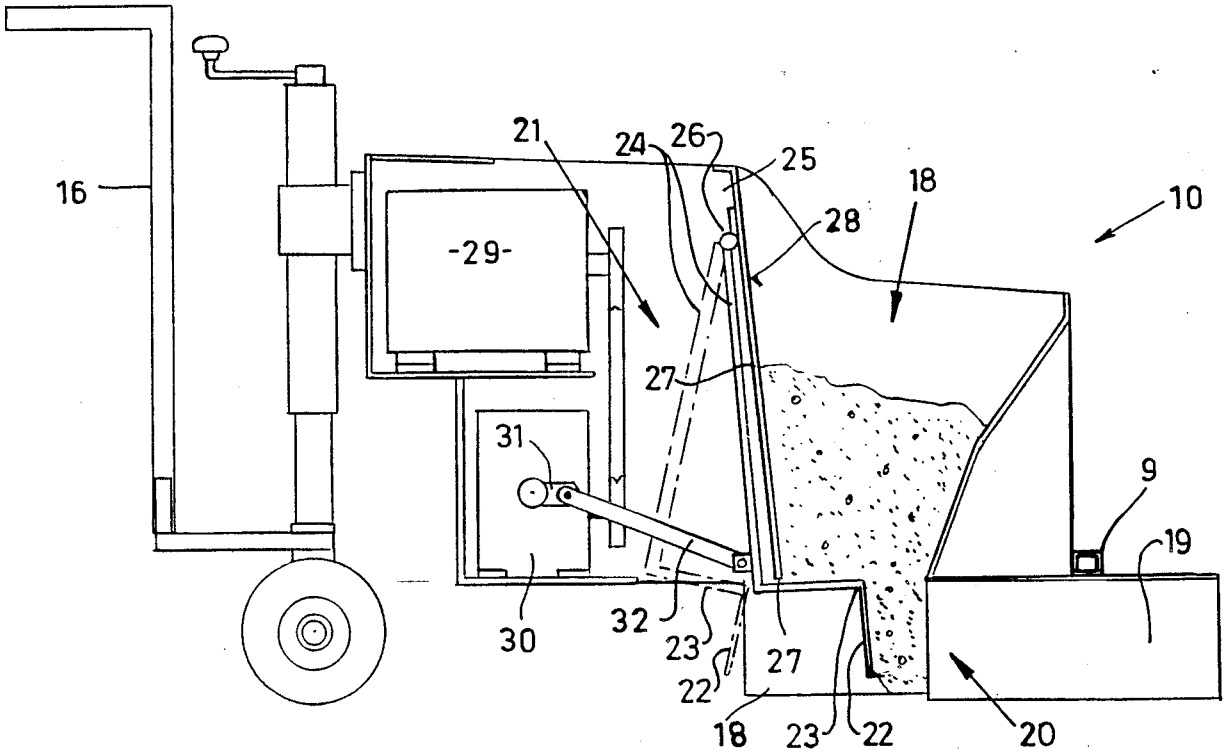
FIG. 3 is a diagrammatic cross-sectional view illustrating the pivotal action of the pusher assembly.

As illustrated in FIG. 3, the hopper 17 feeds material towards the inlet end 20 of the mold 19 and a pusher assembly 21 is supported for pivotal movement through the lower portion of the hopper 18 so as to force concrete mix, in use, rearwardly through the mold 19. The pusher assembly 21 is illustrated in dotted outline in its forward position and it is reciprocated between its rear and forward positions by drive means as hereinafter described.

In this embodiment the pusher assembly 21 includes a planar pusher plate 22 fixed rigidly to a top mounting plate 23, the rear portion of which is supported from upwardly extending mounting bars 24 which connect to the side walls 25 of the body 11 by a transverse axle 26. The pusher plate 22 extends across the hopper 17 closely between the opposed side walls 25 and it will be seen that the pusher plate in its forward position is inclined downwardly and forwardly from the lower edge 27 of the hopper's rear wall 28. This arrangement facilitates flow of concrete through the hopper to the lower portion thereof. As the pusher plate 22 moves rearwardly through the lower portion of the hopper towards the mold 19, its inclination reverses so that at its extreme rearward position it is inclined downwardly and rearwardly adjacent the entrance to the mold 19.

The leading portion of the body 11 supports a drive motor 29 which is coupled to a right angle drive gearbox 30 which operates a crank shaft 31 interconnected to the pusher assembly 21 via a connecting rod 32 in conventional manner.

In use, rearward movement of the pusher plate 22 forces concrete mix into the mold whereby concrete is extruded from the rear end of the mold in the cross-sectional configuration of the mold. This action causes the machine 10 to travel forwards. In arrangements in which the transverse cross-sectional area of the mold is less than that of the plate 22, excess concrete forced rearwardly by the plate 22 is squeezed upwardly into the hopper due to the motion and inclination of the plate 22 so as to prevent an overload arising through build-up of material between the pusher 22 and complementary end face portions of the mold 19 which blank off the rectangular hopper discharge opening extending between the side plates 18 in order to match that discharge opening to the mold section.

This upward movement of the concrete also ensures that excess concrete is not forced beneath the side walls of the mold 19 as this would result in the latter being elevated above its normal datum position. However other beneficial operating effects result from the pivotal mounting of the pusher means and accordingly the pusher face may be disposed parallel to the mold inlet face if desired.

The drive motor 29 may be supported above the mold with linkages extending forwardly through or beside the hopper to the pusher means. This arrangement enables the overall length of the machine to be reduced whereby it may have a smaller turning circle.

Of course other geometric arrangements may be utilized to achieve the result described above and such and other arrangements and modifications as would be apparent to persons skilled in the art are deemed to fall within the broad scope and ambit of this invention as is defined by the appended claims.

I claim:

1. Concrete molding apparatus of the type having a mold through which concrete is extruded, said apparatus being movable in an extrusion direction and including:

hopper means mounted at an entrance of said mold;

extruding means for forcing concrete through said mold, said extruding means including pusher means; and means for supporting said pusher means for pivotal motion above said mold whereby said pusher means pivots during movement towards and away from said mold;

said pusher means including a top mounting plate and a pusher plate fixed to said mounting plate for movement thereof;

said pusher plate having a rectangular pusher face which extends substantially across the width of said mold;

said means supporting said pusher means supports said pusher face for movement in the extrusion direction to a rearward inclined position adjacent the mold entrance at which an upper portion of said pusher face is spaced from said entrance further than a lower portion of said pusher face;

said pusher means being supported by said supporting means for movement in the direction opposite to the extrusion direction to a forward position at which said pusher face extends downwardly and forwardly from a front face of said hopper means such that movement of concrete through said hopper means into a lower portion thereof is not inhibited.

2. Concrete molding apparatus according to claim 1, including steerable and height adjustable wheels for supporting the front portion of said apparatus, said mold constituting the rear portion of said apparatus.

3. Concrete molding apparatus according to claim 1, wherein said pusher plate is connected at its upper portion to said supporting plate, whereby at the end of an extruding step said upper portion of said pusher plate is spaced from the mold entrance further than is the lower portion, while at the beginning of a feeding stage, said pusher plate is closer to said mold entrance.

4. Concrete molding apparatus according to claim 1, wherein said supporting means includes means for supporting said pusher plate for movement proximate to a wall of said hopper means so that said pusher plate pivots about a pivot axis spaced above said pusher plate.

5. Concrete molding apparatus according to claim 4, wherein said pivot axis is disposed forwardly of said pusher plate in said extrusion direction and proximate to a rear wall of said hopper means whereby said pusher plate pivotally moves about said pivot axis.

6. Concrete molding apparatus according to claim 1, including means for accommodating interchangeable molds, and wherein said mold has lower longitudinal edges which rest upon the ground.

7. Concrete molding apparatus according to claim 1, including a body portion upwardly extending mounting bars, and wherein a rear portion of said top mounting plate is fixed to said upwardly extending mounting bars, said upwardly extending mounting bars coupling said top mounting plate to side walls of said body portion, and said side wall of said body portion being associated with said hopper means.

8. Concrete molding apparatus according to claim 1, wherein said hopper means includes a hopper having a front face, and said pusher plate is supported proximate to a front face of said hopper, in said extrusion direction thereof whereby when said pusher plate moves to a forward position in a direction opposite to said extrusion direction at which said pusher face extends downwardly and forwardly from said front face of said hopper so as not to inhibit movement of concrete through said hopper into the lower portion thereof.

9. Concrete molding apparatus according to claim 1, including a pivot frame and a pivot mounting said pusher plate rigidly to said pivot frame, said pivot frame extending upwardly to said pivot mounting and being associated with a top mounting plate and rigidly connected therewith, said pusher plate being fixed rigidly to said top mounting plate which is supported by upwardly extending bars which connect to the side walls of the body, such that said pusher plate in its forward position is inclined downwardly and forwardly of a rear wall of said hopper means.

10. Concrete molding apparatus according to claim 9, wherein said mold includes in said extrusion direction a front portion and a rear portion spaced rearwardly of said front portion in said extrusion direction, and said rear portion forms a rear portion of said apparatus, said apparatus includes a body portion supported by steerable and height adjustable wheels, and said front portion of said mold is operatively supported by said steerable and height adjustable wheels.

11. Concrete molding apparatus according to claim 1, wherein said apparatus has a direction of movement in its extrusion direction during operation and said pivot axis is disposed forwardly of said pusher plate in a direction of movement of said apparatus and proximate to a wall of said hopper means closest to said direction of movement whereby said pusher plate pivotably moves about said pivot axis.

12. Concrete molding apparatus according to claim 1, wherein said supporting means includes an upwardly extending mounting bar.

13. Concrete molding apparatus according to claim 1, wherein said mold constitutes the rear portion of said apparatus and the front portion thereof is supported by steerable and height adjustable wheels, and the rear portion thereof having lower longitudinal edges which rest on the ground to permit laying of edging flush to fixed objects.

14. Concrete molding apparatus according to claim 10, including a hopper, said mold being detachably secured to the underside of said hopper.

15. Concrete apparatus according to claim 1, wherein the position of said pusher plate is variable so that the inclination of said pusher plate is variable.

16. Concrete molding apparatus capable of having interchangeable molds with a single plunger, comprising:

a mold through which concrete is extruded;

a hopper coupled with said mold at a mold entrance;

extruding means for forcing concrete through said mold;

said extruding means including a one-piece pivotal member comprising a mounting plate and a pusher plate fixedly connected therewith and movable therewith; and means positioned outside said hopper for pivotally supporting said mounting plate and said pusher plate for pivotal motion above said mold during movement towards and away from said mold such that said pusher plate in a forward movement away from said mold is inclined downwardly and forwardly from a lower edge of a rear wall of said hopper, and said pusher plate in a rearward movement to said mold is inclined downwardly and rearwardly adjacent said mold entrance.

17. Concrete molding apparatus according to claim 16, wherein said rear wall is a one-piece non-movable rear wall, and said onepiece pivotal member of said extruding means comprises said molding plate and said pusher plate is pivotal relative to said non-movable rear wall of said hopper, said hopper having an open base for receiving said extruding means, and said extruding means being the only moving parts entering the base of said hopper.

18. Concrete molding apparatus according to claim 16, wherein said hopper has straight edges to permit laying of edging flush to fixed objects.

* * * * *